US011959482B2

(12) United States Patent
Sugihara

(10) Patent No.: US 11,959,482 B2
(45) Date of Patent: Apr. 16, 2024

(54) VANE PUMP

(71) Applicant: KYB Corporation, Tokyo (JP)

(72) Inventor: Masamichi Sugihara, Gifu (JP)

(73) Assignee: KYB CORPORATION, Tokyo (JP)

( * ) Notice: Subject to any disclaimer, the term of this patent is extended or adjusted under 35 U.S.C. 154(b) by 222 days.

(21) Appl. No.: 17/600,566

(22) PCT Filed: Mar. 16, 2020

(86) PCT No.: PCT/JP2020/011467
§ 371 (c)(1),
(2) Date: Sep. 30, 2021

(87) PCT Pub. No.: WO2020/213327
PCT Pub. Date: Oct. 22, 2020

(65) Prior Publication Data

US 2022/0170459 A1 Jun. 2, 2022

(30) Foreign Application Priority Data

Apr. 17, 2019 (JP) ..... 2019-078491

(51) Int. Cl.

| | |
|---|---|
| ***F04C 14/26*** | (2006.01) |
| ***F01C 21/08*** | (2006.01) |
| ***F01C 21/10*** | (2006.01) |
| ***F04C 2/344*** | (2006.01) |
| ***F04C 2/356*** | (2006.01) |
| ***F04C 15/06*** | (2006.01) |

(52) U.S. Cl.
CPC ..... *F04C 2/3448* (2013.01); *F04C 2240/20* (2013.01); *F04C 2240/30* (2013.01)

(58) Field of Classification Search
CPC ..... F04C 15/06; F04C 15/062; F04C 14/26; F04C 2/344; F04C 2/356; F01C 21/0836; F01C 21/3446; F01C 21/108; F01C 21/0863
See application file for complete search history.

(56) References Cited

U.S. PATENT DOCUMENTS

2007/0243094 A1* 10/2007 Fujita ..... F04C 15/062 418/270

FOREIGN PATENT DOCUMENTS

| | | | | |
|---|---|---|---|---|
| CN | 101054973 A | | 10/2007 | |
| JP | 2007278258 A | | 10/2007 | |
| JP | 2014-126043 A | | 7/2014 | |
| JP | 2017145699 A | * | 8/2017 | ..... F01C 21/0836 |

OTHER PUBLICATIONS

English copy of JP2017145699 by PE2E Jan. 7, 2023.*

* cited by examiner

*Primary Examiner* — Deming Wan
(74) *Attorney, Agent, or Firm* — Rabin & Berdo, P.C.

(57) ABSTRACT

A vane pump includes: pump chambers formed by a rotor, a cam ring, and vanes; a first suction port that guides working fluid guided by a suction passage to the pump chambers; a second suction port that guides the working fluid guided from the suction passage through a communication passage to the pump chambers; and a return passage to which excessive fluid of the working fluid discharged from the pump chambers is guided. The return passage has: a body-internal passage through which the excessive fluid flows along an axis direction at an outer side of the cam ring in a radial direction; and a turning passage that reverses the excessive fluid guided through the body-internal passage towards the second suction port.

5 Claims, 10 Drawing Sheets

VANE PUMP

TECHNICAL FIELD

The present invention relates to a vane pump.

BACKGROUND ART

There is a known vane pump in which a part of working oil (excessive oil) discharged from pump chambers is recycled to the pump chambers (see JP2014-126043A). In the vane pump described in JP2014-126043A, an inlet provided in a pump housing is in direct communication with a sub-suction port from a sub-suction oil passage provided in the pump housing and is in communication with a main suction port from a main suction oil passage through an outer circumference oil passage provided around a cam ring in the pump housing.

In addition, in the vane pump described in JP2014-126043A, a return oil passage, which is branched from a switching valve provided in a sub-discharge oil passage communicating with a sub-discharge port of the sub-pump chamber, is provided as a recycling configuration of the excessive oil in a cover, and the return oil passage is made to communicate with the main suction port of a main pump chamber via the main suction oil passage provided in the pump housing. Therefore, the excessive oil discharged from the sub-discharge port is recycled to the main suction port via the return oil passage.

SUMMARY OF INVENTION

With the vane pump described in JP2014-126043A, the excessive oil that has been guided to the return oil passage flows into the main suction port and also flows into the outer circumference oil passage. The direction of the flow of the excessive oil being guided to the outer circumference oil passage is opposite from that of the flow of the working oil flowing from the inlet towards the main suction port through the outer circumference oil passage. Therefore, there is a concern that the flow of the working oil being sucked into the main suction port and the sub-suction port from the inlet is inhibited by the excessive oil, and a suction property of the vane pump is deteriorated.

An object of the present invention is to improve a suction property of a vane pump.

According to one aspect of the present invention, a vane pump includes: a rotor configured to be rotationally driven; a plurality of vanes provided so as to be capable of freely reciprocating in a radial direction with respect to the rotor; a cam ring having an inner circumference cam face on which tip end portions of the plurality of vanes slide with rotation of the rotor; a body having an accommodating portion for accommodating the rotor and the cam ring; a cover attached to the body to close the accommodating portion; pump chambers formed by the rotor, the cam ring, and the adjacent vanes; a first suction port configured to guide working fluid to the pump chambers, the working fluid being guided by a suction passage provided in the body; a second suction port configured to guide the working fluid to the pump chambers, the working fluid being guided from the suction passage through a communication passage provided in the cover or the body; and a return passage to which excessive fluid is guided, the excessive fluid being derived from the working fluid discharged from the pump chambers. The return passage has: an axial direction passage through which the excessive fluid flows along a rotation-axis direction of the rotor at an outer side of the cam ring in a radial direction; and a turning passage configured to reverse the excessive fluid towards the second suction port, the excessive fluid being guided through the axial direction passage.

DESCRIPTION OF EMBODIMENTS

A vane pump according to an embodiment of the present invention will be described below with reference to the drawings. The vane pump is used as a fluid pressure source for a fluid hydraulic apparatus mounted on a vehicle, such as a power steering apparatus, a transmission, and so forth. Although a description is given to the vane pump using working oil as working fluid in this description, other fluid such as working water, etc. may also be used as the working fluid.

Figure 1:
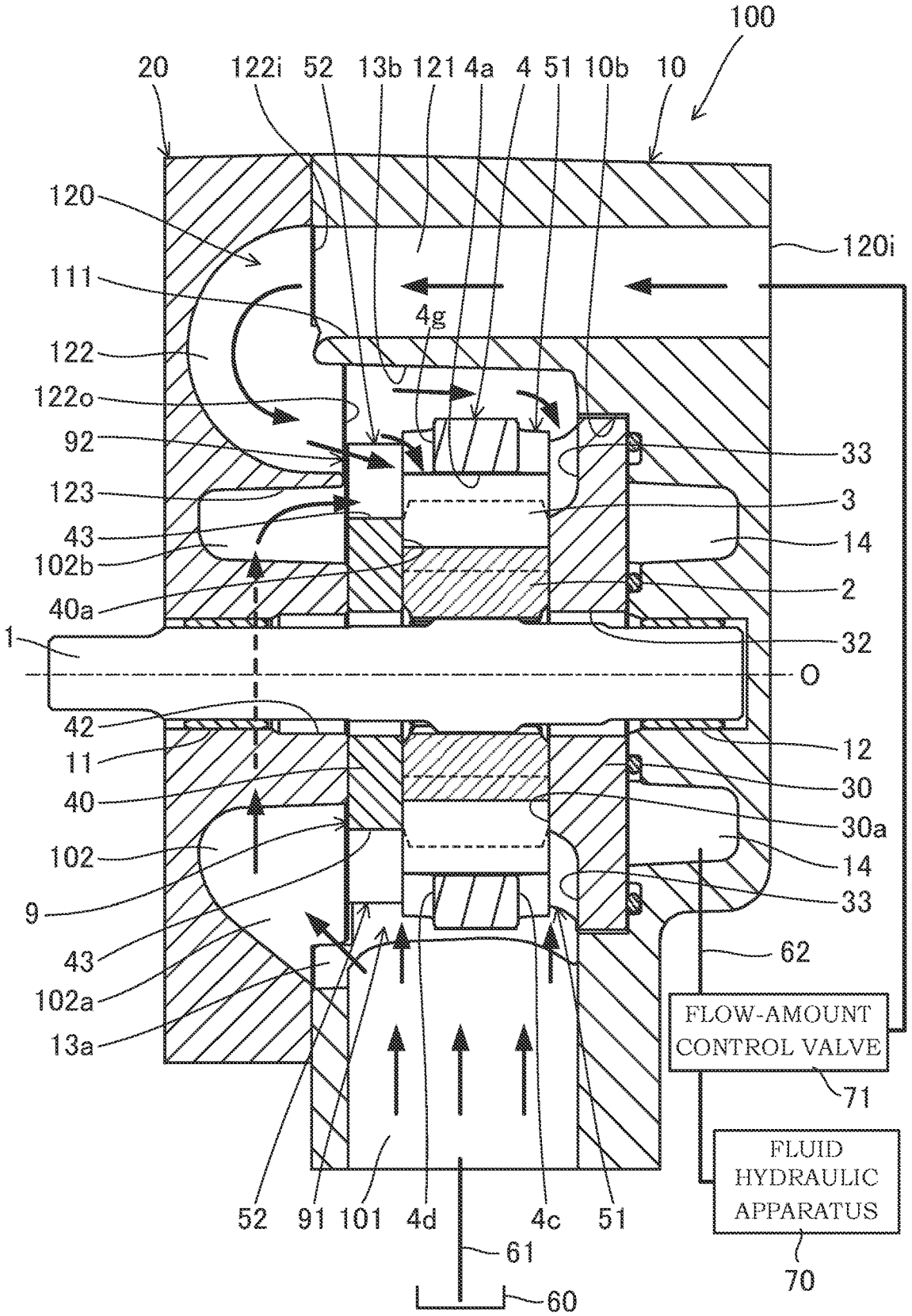
FIG. 1 is a sectional view of a vane pump according to an embodiment of the present invention.
Figure 2:
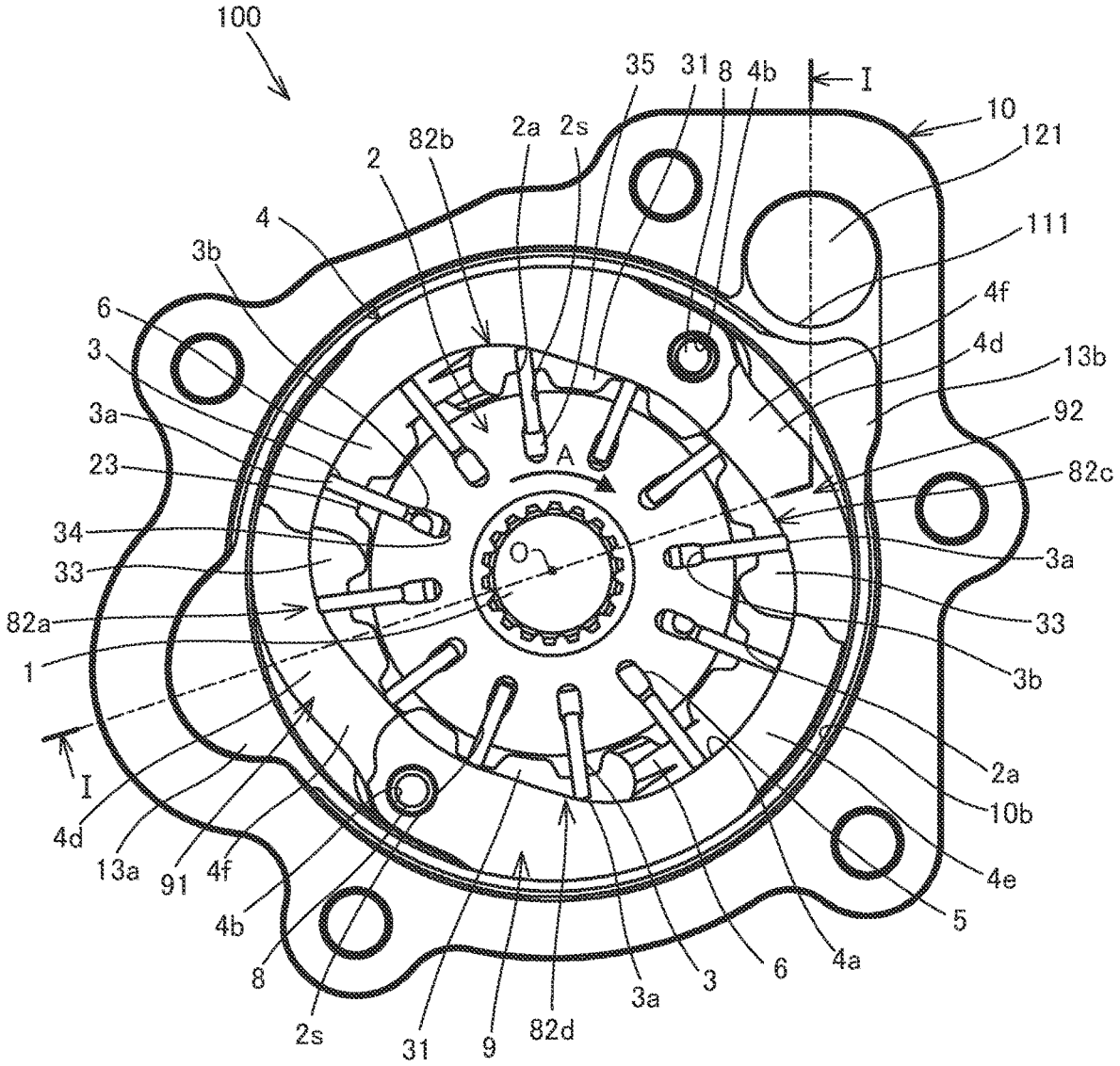
FIG. 2 is a diagram showing an internal structure of the vane pump and shows a state in which a cover and a cover-side side plate are removed.

FIG. 1 is a sectional view of a vane pump 100. FIG. 2 is a diagram showing an internal structure of the vane pump 100 and shows a state in which a cover 20 and a cover-side side plate 40 are removed. Here, FIG. 1 schematically shows a cross section taken along a line I-I shown in FIGS. 2 and 4.

As shown in FIGS. 1 and 2, the vane pump 100 is provided with: a pump cartridge (hereinafter, simply referred to as a cartridge) 9 that sucks the low-pressure working oil and discharges the high-pressure working oil; a body 10 that has an accommodating concave portion 10*b* serving as an accommodating portion accommodating the cartridge 9; the cover 20 that is attached to the body 10 to close an opening of the accommodating concave portion 10*b*; and a drive shaft 1 that is rotatably supported by the body 10 and the cover 20 via bearings 11 and 12.

The cartridge 9 is provided with: a rotor 2 that is rotationally driven by being linked to the drive shaft 1; a plurality of slits 2*s* that open at an outer circumferential surface of the rotor 2; a plurality of vanes 3 that are respectively received in the slits 2*s* of the rotor 2 in a freely slidable manner; a cam ring 4 that accommodates the rotor 2 and the vanes 3; and a pair of side members (a body-side side plate 30 and the cover-side side plate 40) that are arranged so as to sandwich the rotor 2 and the cam ring 4.

The vane pump 100 is driven by a driving device (not shown), such as an engine, an electric motor, and so forth, and thereby, the rotor 2 linked to the drive shaft 1 is rotationally driven in the clockwise direction as shown by an arrow A in FIG. 2 to generate the fluid pressure.

In the following, the direction extending along an rotation center axis O of the rotor 2 will be referred to as "the axial direction", the radiating direction centered at the rotation center axis O of the rotor 2 will be referred to as "the radial direction", and the rotating direction of the rotor 2 when the vane pump 100 is operated will be referred to as "the rotation direction".

As shown in FIG. 1, the body-side side plate 30 is a disc-shaped member arranged between a bottom surface of the accommodating concave portion 10*b* and the cam ring 4, and one end surface of the rotor 2 in the axial direction (the right side surface in the figure) comes into sliding contact with the body-side side plate 30 and the one end surface of the cam ring 4 in the axial direction comes into contact with the body-side side plate 30.

The cover-side side plate 40 is a disc-shaped member arranged between the cover 20 and the cam ring 4, and other end surface of the rotor 2 in the axial direction (the left side surface in the figure) comes into sliding contact with the cover-side side plate 40 and the other end surface of the cam ring 4 in the axial direction comes into contact with the cover-side side plate 40. The cover-side side plate 40 is a plate member arranged between a communication passage 102, which will be described below, and pump chambers 6.

As described above, the body-side side plate 30 and the cover-side side plate 40 are arranged so as to respectively face both end surfaces of the rotor 2 and the cam ring 4 in the axial direction. In other words, the body-side side plate 30 and the cover-side side plate 40 are arranged so as to sandwich the rotor 2 and the cam ring 4 in the axial direction.

The rotor 2, the plurality of vanes 3, the cam ring 4, the cover-side side plate 40, and the body-side side plate 30 are assembled as the cartridge 9, and the cartridge 9 is accommodated in the accommodating concave portion 10*b* of the body 10. In this state, by attaching the cover 20 to the body 10, the accommodating concave portion 10*b* is closed.

As shown in FIG. 2, the plurality of the slits 2*s* are formed in the rotor 2 in a radiating pattern. The slits 2*s* respectively have opening portions 2*a* at the outer circumference of the rotor 2. The opening portions 2*a* of the slits 2*s* are respectively formed at raised portions 23 that protrude from the outer circumference of the rotor 2 outwards in the radial direction. In other words, the raised portions 23 are formed on the outer circumference of the rotor 2 such that the number thereof corresponds to that of the slits 2*s*. Each of the raised portions 23 supports the vane 3 on the front and back sides in the rotation direction.

The vanes 3 are provided so as to be capable of reciprocating in a radial direction with respect to the rotor 2. Each of the vanes 3 has a rectangular flat plate shape and is inserted into the slit 2*s* so as to be freely slidable. Each of the vanes 3 has a tip end portion 3*a* that is an end portion in the direction projecting out from the slit 2*s* and a base-end portion 3*b* that is an end portion at the opposite side of the tip end portion 3*a*. In the slits 2*s*, back pressure chambers 5 are respectively formed on the bottom portion side of the slits 2*s* with an inner circumferential surface of the slits 2*s* and the base-end portions 3*b* of the vanes 3. The back pressure chambers 5 are in communication with discharge ports 31, which will be described later, and the high-pressure working oil is guided to the back pressure chambers 5 from the discharge ports 31. The vanes 3 are pushed by pressure in the back pressure chambers 5 in the direction in which the vanes 3 project out from the slits 2*s*.

The cam ring 4 is an annular member having an inner circumference cam face 4*a* serving as an inner circumferential surface having a substantially oval shape and pin holes 4*b* through which positioning pins 8 are inserted. The inner circumference cam face 4*a* is an surface on which the tip end portions 3*a* of the plurality of vanes 3 slide along with the rotation of the rotor 2.

As the rotor 2 is rotated, a centrifugal force acts on the vanes 3. The vanes 3 are biased by this centrifugal force in the directions in which the vanes 3 project out from the slits 2*s*. In other words, the vanes 3 are biased in the directions (outwards in the radial direction) in which the vanes 3 project out from the slits 2*s* by the fluid pressure in the back pressure chambers 5 pushing the base-end portions 3*b* and the centrifugal force generated due to rotation of the rotor 2. As the vanes 3 are biased outwards in the radial direction, the tip end portions 3*a* of the vanes 3 are brought into sliding contact with the inner circumference cam face 4*a* of the cam ring 4. Thereby, in the cam ring 4, the pump chambers 6 are formed by the outer circumferential surface of the rotor 2, the inner circumference cam face 4*a* of the cam ring 4, the adjacent vanes 3, the body-side side plate 30, and the cover-side side plate 40.

Because the inner circumference cam face 4*a* of the cam ring 4 has the substantially oval shape, as the rotor 2 is rotated, the displacement of each of the pump chambers 6, which are defined by the respective vanes 3 in sliding contact with the inner circumference cam face 4*a*, is repeatedly expanded and contracted. The working oil is sucked into the pump chambers 6 in an expansion region (suction region) where the pump chambers 6 are expanded, and the working oil is discharged from the pump chambers 6 in a contraction region (discharge region) where the pump chambers 6 are contracted.

The vane pump 100 according to this embodiment has a first suction region 82*a* and a first discharge region 82*b* in which the vanes 3 undergo a first reciprocating movement and a second suction region 82*c* and a second discharge region 82*d* in which the vanes 3 undergo a second reciprocating movement. While the rotor 2 completes a full rotation, the pump chambers 6 are expanded in the first suction region 82*a*, contracted in the first discharge region 82*b*, expanded in the second suction region 82*c*, and contracted in the second discharge region 82*d*. Although the vane pump 100 according to this embodiment has two suction regions 82*a* and 82*c* and two discharge regions 82*b* and 82*d*, the configuration is not limited thereto, and the vane pump 100 may have a configuration in which three or more suction regions and three or more discharge regions are provided.

As shown in FIG. 1, the vane pump 100 is further provided with: a suction passage 101 that is connected to a tank 60 and guides the working oil stored in the tank 60 to the pump chambers 6 positioned in the suction regions 82*a* and 82*c*; a discharge passage (not shown) that guides the working oil that has been discharged from the pump chambers 6 positioned in the discharge regions 82*b* and 82*d*; and a return passage 120 through which excessive oil (excessive fluid) that is a part of the working oil that has been discharged from the pump chambers 6 positioned in the discharge regions 82*b* and 82*d* is guided.

An annular high-pressure chamber 14 is formed by the body 10 and the body-side side plate 30 on the bottom surface side of the accommodating concave portion 10*b* of the body 10. The high-pressure chamber 14 is connected to an external fluid hydraulic apparatus 70 (for example, a power steering apparatus, a transmission, and so forth) of the vane pump 100 via a discharge passage 62.

The working oil that has been guided to the suction passage 101 provided in the body 10 is then sucked into the pump chambers 6 through a first suction port 91 and a second suction port 92 of the cartridge 9. Details of the first suction port 91 and the second suction port 92 will be described later.

As shown in FIGS. 1 and 2, a first introduction concave portion 13*a* that is connected to an end portion of the suction passage 101 at the exit side of the working oil is formed at the position of the body 10 corresponding to the first suction port 91 of the cartridge 9. A second introduction concave portion 13*b* that is connected to an end portion of the return passage 120 at the exit side of the working oil is formed at the position of the body 10 corresponding to the second suction port 92 of the cartridge 9. The first introduction concave portion 13*a* and the second introduction concave portion 13*b* are respectively provided at the positions opposed to each other such that the cam ring 4 is located therebetween.

As shown in FIG. 1, the communication passage 102 that is in communication with the suction passage 101 is provided in the cover 20. The cartridge 9 is assembled into the accommodating concave portion 10*b* such that the first suction port 91 is positioned at the end portion of the suction passage 101 and such that the second suction port 92 is positioned at the end portion (the upper end portion in the figure) of the communication passage 102.

As shown in FIGS. 1 and 2, in the cam ring 4, cut-out portions 4*c* and 4*d* are provided so as to penetrate from the outer circumferential surface of the cam ring 4 to the inner circumference cam face 4*a*. One cut-out portions 4*c* each opens at the axial direction end surface that is in contact with the body-side side plate 30, and the other cut-out portions 4*d* each opens at the axial direction end surface that is in contact with the cover-side side plate 40.

In other words, the cam ring 4 has wide-width portions 4*e* (see FIG. 5) that are each in contact with the body-side side plate 30 and the cover-side side plate 40 and narrow-width portions 4*f* (see FIG. 5) that are each not in contact with the body-side side plate 30 and the cover-side side plate 40. The cut-out portions 4*c* and 4*d* are respectively provided on both sides of the narrow-width portions 4*f* in the axial direction.

Figure 3:
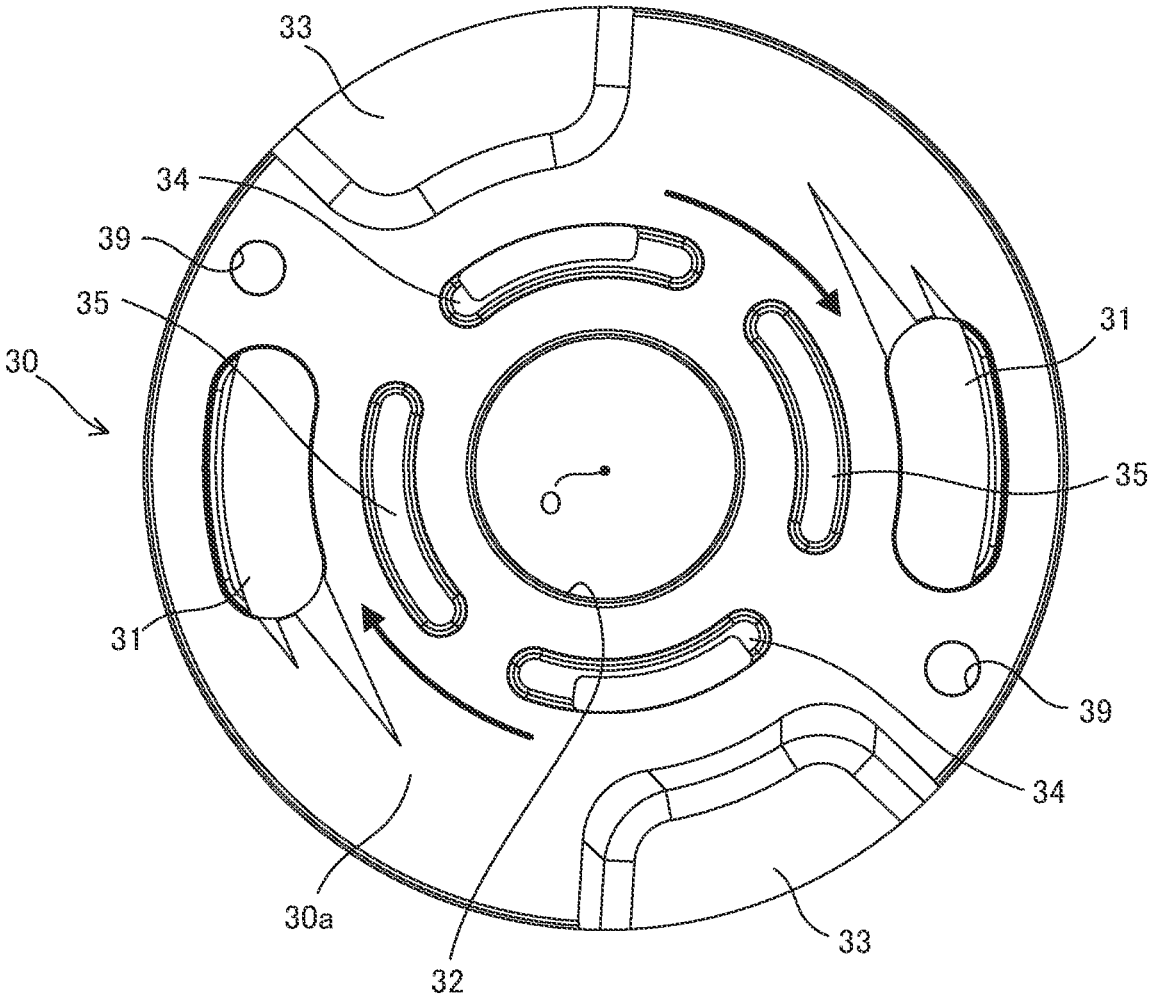
FIG. 3 is a front view of a body-side side plate, viewed from a cam ring side.

FIG. 3 is a front view of the body-side side plate 30, viewed from the cam ring 4 side. As shown in FIG. 3, the body-side side plate 30 is a circular plate-like member. The body-side side plate 30 has: a sliding surface 30*a* including a region on which the end surfaces of the vanes 3 in the axial direction slide; a through hole 32 through which the drive shaft 1 is inserted; the discharge ports 31 that are formed so as to respectively correspond to the first discharge region 82*b* and the second discharge region 82*d*; recessed portions 33 that are formed so as to respectively correspond to the first suction region 82*a* and the second suction region 82*c*; and pin holes 39 through which the positioning pins 8 are respectively inserted.

The discharge ports 31 are provided at two positions opposed to each other such that the through hole 32 is located therebetween. The discharge ports 31 are each formed to have an arc shape centered at the through hole 32. Each of the discharge ports 31 penetrates through the body-side side plate 30 and communicates with the high-pressure chamber 14 that is formed in the body 10. The discharge ports 31 guide the working oil that has been discharged from the pump chambers 6 to the high-pressure chamber 14. The working oil that has entered the high-pressure chamber 14 is then supplied to the fluid hydraulic apparatus 70 outside the vane pump 100 through the discharge passage 62 (see FIG. 1).

The sliding surface 30*a* of the body-side side plate 30 has a pair of back-pressure grooves 34 that are formed so as to oppose with each other such that the through hole 32 is located therebetween and a pair of back-pressure grooves 35 that are formed so as to oppose with each other such that the through hole 32 is located therebetween. The back-pressure grooves 34, 35 are each formed to have a groove shape that opens at the sliding surface 30*a*. The back-pressure grooves 34, 35 are each formed to have an arc shape centered at the through hole 32 so as to communicate with the plurality of back pressure chambers 5 overlapping with the back-pressure grooves 34, 35. In addition, the back-pressure grooves 34, 35 communicate with the high-pressure chamber 14.

As shown in FIGS. 1 and 3, the recessed portions 33 are provided at two positions opposed to each other such that the through hole 32 is located therebetween. The recessed portions 33 are respectively formed at positions corresponding to the first introduction concave portion 13*a* and the second introduction concave portion 13*b* of the body 10. The recessed portions 33 are each formed to have a recessed shape that opens at an outer circumferential surface of the body-side side plate 30 and an end surface of the body-side side plate 30 that is in contact with the cam ring 4. An outer circumferential end of the recessed portions 33 reaches the outer circumferential surface of the body-side side plate 30. The depth of the recessed portions 33, in other words, the length of the recessed portions 33 in the axial direction from the end surface of the body-side side plate 30 that is in contact with the cam ring 4 to a bottom surface of the recessed portions 33 is smaller than the width (the thickness) of the body-side side plate 30.

Figure 4:
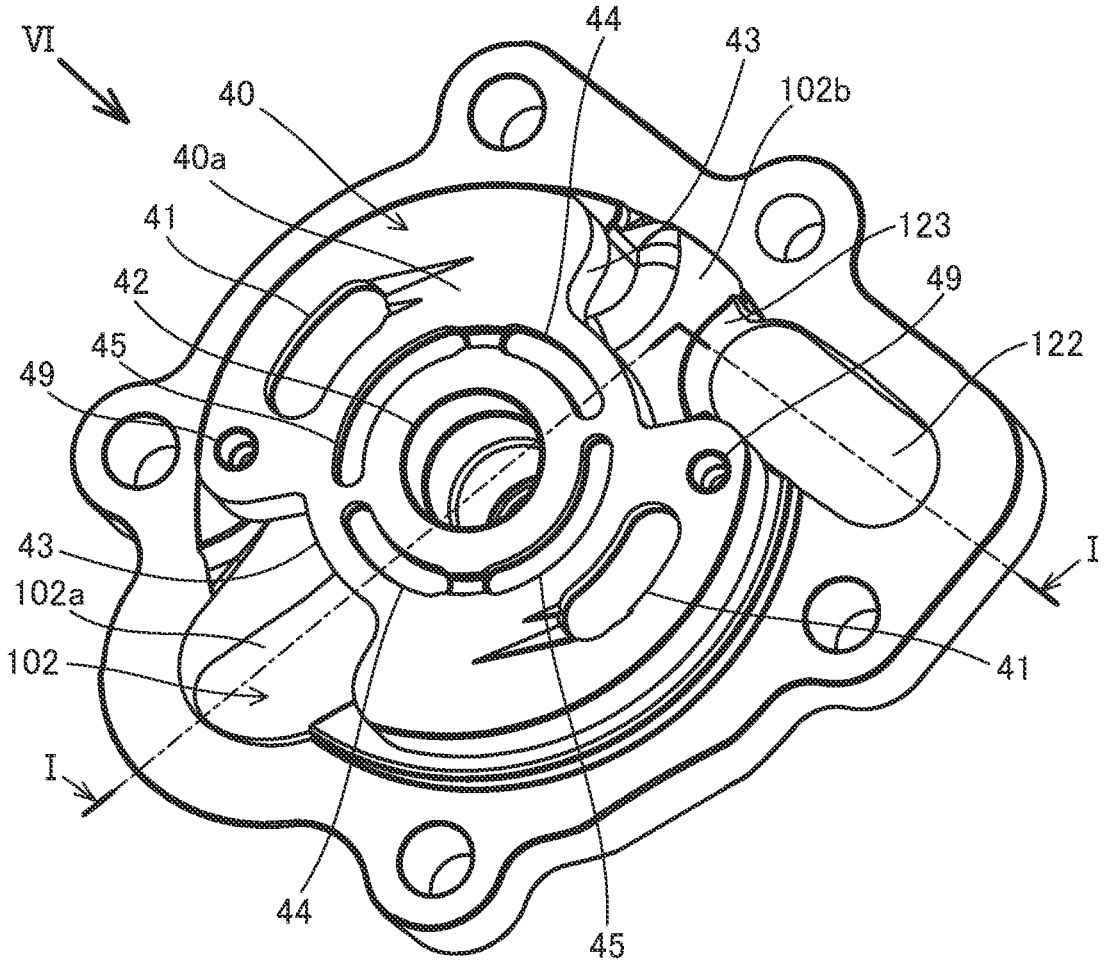
FIG. 4 is a perspective view of a cover and the cover-side side plate.

FIG. 4 is a perspective view showing the cover 20 and the cover-side side plate 40. As shown in FIG. 4, the cover-side side plate 40 is a circular plate-like member having: a sliding surface 40*a* of a sliding surface 40*a* including a region on which the end surfaces of the vanes 3 in the axial direction slide; a through hole 42 through which the drive shaft 1 is inserted; opposing grooves 41 that are formed so as to respectively correspond to the first discharge region 82*b* and the second discharge region 82*d*; cut-out portions 43 that are formed so as to respectively correspond to the first suction region 82*a* and the second suction region 82*c*; and pin holes 49 through which the positioning pins 8 are respectively inserted. The cover-side side plate 40 is aligned with respect to the cam ring 4 and the body-side side plate 30 by the positioning pins 8.

The opposing grooves 41 are each a groove formed to have an arc shape centered at the through hole 42 and are formed so as to respectively face the discharge ports 31 in the axial direction such that the vanes 3 and the pump chambers 6 are located therebetween. In other words, each of the opposing grooves 41 is in communication with each of the discharge ports 31 via the pump chambers 6. Because the pressure acting on the opposing grooves 41 is the same as the pressure acting on the discharge ports 31, the force acting on the vanes 3 by the pressure in the discharge ports 31 is cancelled out by the pressure in the opposing grooves 41. Thus, it is possible to prevent the vanes 3 from being pushed against the cover-side side plate 40 by the pressure in the discharge ports 31.

As shown in FIGS. 1 and 4, the sliding surface 40*a* of the cover-side side plate 40 has a pair of back-pressure grooves 44 that are formed so as to oppose with each other such that the through hole 42 is located therebetween and a pair of back-pressure grooves 45 that are formed so as to oppose with each other such that the through hole 42 is located therebetween. The back-pressure grooves 44, 45 are each formed to have a groove shape that opens at the sliding surface 40*a*. The back-pressure grooves 44, 45 are each formed to have an arc shape centered at the through hole 32 so as to communicate with the plurality of back pressure chambers 5 overlapping with the back-pressure grooves 44, 45. The back-pressure grooves 44 communicate with the back-pressure grooves 45 via communication grooves. In addition, the back-pressure grooves 44, 45 communicate with the high-pressure chamber 14.

The cut-out portions 43 are provided at two positions opposed to each other such that the through hole 42 is located therebetween. The cut-out portions 43 are respectively formed at positions corresponding to the first introduction concave portion 13*a* and the second introduction concave portion 13*b* of the body 10. The cut-out portions 43 are each formed so as to open at an outer circumferential surface of the cover-side side plate 40 and so as to penetrate through between both end surfaces in the axial direction. The cut-out portions 43 are each formed across the entire width at a part of the cover-side side plate 40 along the circumferential direction so as to have a recessed shape that is recessed in the radial direction from the outside towards the inside.

Figure 5:
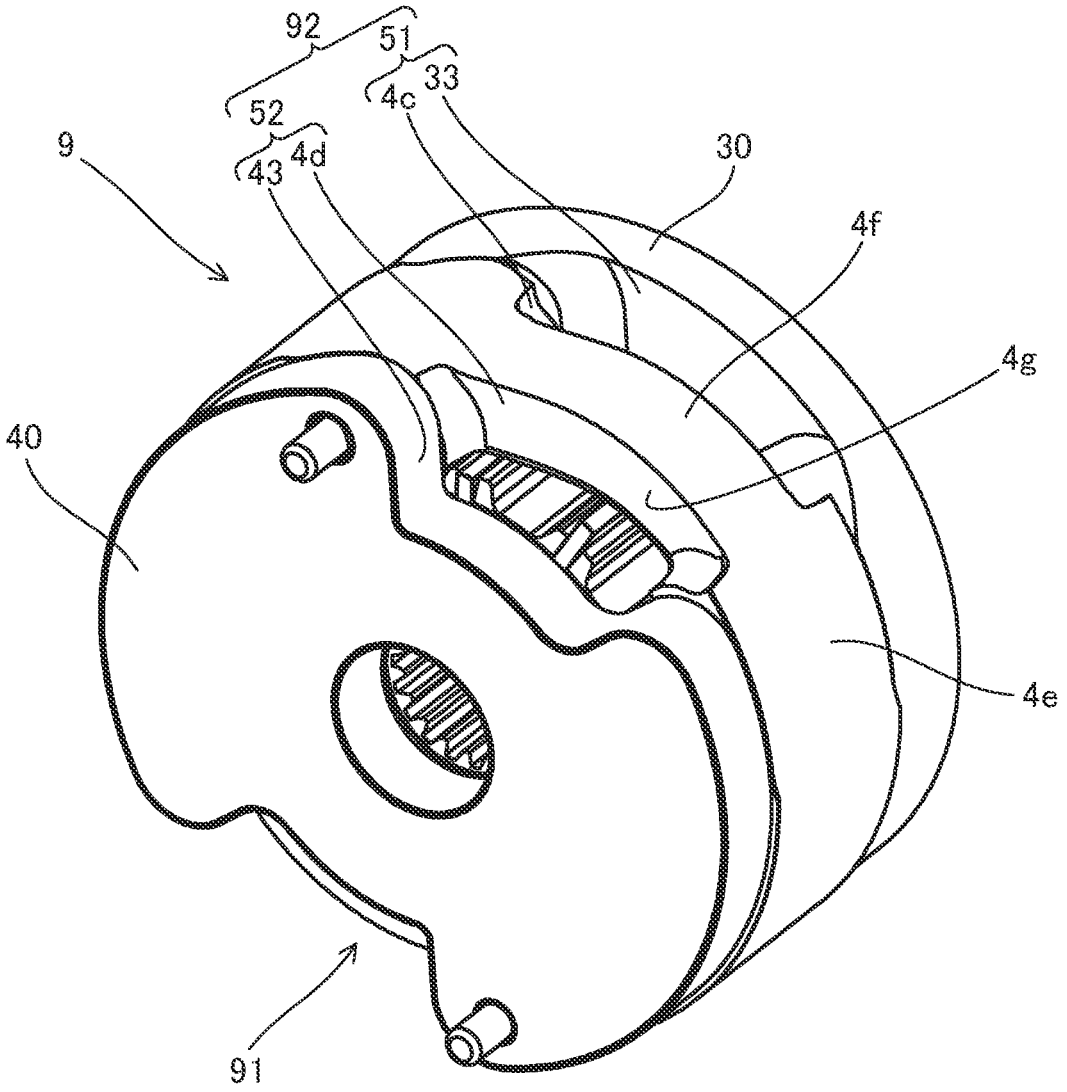
FIG. 5 is a perspective view of a cartridge.

FIG. 5 is a perspective view of the cartridge. As shown in FIGS. 1 and 5, in a state in which the body-side side plate 30 is assembled to the cam ring 4, the recessed portions 33 of the body-side side plate 30 are arranged so as to be respectively adjacent to the cut-out portions 4*c* of the cam ring 4. Body-side side ports 51 of the cartridge 9 are formed by the recessed portions 33 of the body-side side plate 30 and the cut-out portions 4*c* of the cam ring 4.

As shown in FIGS. 1 and 5, in a state in which the cover-side side plate 40 is assembled to the cam ring 4, the cut-out portions 43 of the cover-side side plate 40 are arranged so as to be respectively adjacent to the cut-out portions 4*d* of the cam ring 4. Cover-side side ports 52 of the cartridge 9 are formed by the cut-out portions 43 of the cover-side side plate 40 and the cut-out portions 4*d* of the cam ring 4.

The cartridge 9 has a pair of body-side side ports 51 and a pair of cover-side side ports 52. Here, the body-side side port 51 and the cover-side side port 52 that are provided in the first suction region 82*a* are referred to as the first suction port 91 of the cartridge 9. In addition, the body-side side port 51 and the cover-side side port 52 that are provided in the second suction region 82*c* are referred to as the second suction port 92. In other words, the first suction port 91 has the body-side side port 51 and the cover-side side port 52 that are provided in the first suction region 82*a*, and the second suction port 92 has the body-side side port 51 and the cover-side side port 52 that are provided in the second suction region 82*c*.

The first suction port 91 guides the working oil that has been guided by the suction passage 101 to the pump chambers 6 positioned in the first suction region 82*a*. The second suction port 92 guides the working oil that has been guided from the suction passage 101 via the communication passage 102 provided in the cover 20 to the pump chambers 6 positioned in the second suction region 82*c*.

The return passage 120 will be described in detail with reference to FIG. 1. As shown in FIG. 1, the return passage 120 is connected to a flow-amount control valve 71 that controls a flow amount of the working oil supplied to the fluid hydraulic apparatus 70 via the discharge passage 62 by being discharged from the pump chamber 6, and thereby, the return passage 120 guides the excessive oil that is not supplied to the fluid hydraulic apparatus 70 to the second introduction concave portion 13*b*. The flow-amount control valve 71 may be provided outside the body 10 or may be provided in the body 10.

The return passage 120 has a body-internal passage 121 serving as an axial direction passage provided in the body 10 and a turning passage 122 that is provided in the cover 20 so as to reverse the excessive oil that has been guided by the body-internal passage 121 towards the cover-side side port 52 of the second suction port 92 serving as a side port.

The body-internal passage 121 is formed so as to penetrate through the body 10 in a straight line along the axial direction on the outer side of the second introduction concave portion 13*b* in the radial direction, in other words, on the outer side of the cam ring 4 in the radial direction. An inlet 120*i* of the return passage 120 serving as an opening end of the body-internal passage 121 is formed at one end surface of the body 10 in the axial direction (the right-side end surface in FIG. 1). In addition, a body-internal partition portion 111 is formed between the body-internal passage 121 and the second introduction concave portion 13*b*. Although the body-internal passage 121 is formed so as to be substantially in parallel with the rotation center axis O of the rotor 2, the body-internal passage 121 need not be in a parallel in a strict sense, and it may be formed so as to be slightly angled to the radial direction or the circumferential direction with respect to the rotation center axis O.

The turning passage 122 is a concave portion that is recessed from one end side of the cover 20 in the axial direction (the right end side in FIG. 1) towards the other end side (the left end side in FIG. 1) and is formed so as to have a semicircular cross-sectional shape. A tip end portion of the body-internal partition portion 111 provided between the body-internal passage 121 and the second introduction concave portion 13*b* is positioned at the vicinity of the center of the arc formed by an inner circumferential surface of the turning passage 122.

The turning passage 122 has, as opening portions thereof, an inlet opening portion 122*i* that faces an opening portion of the body-internal passage 121 and an outlet opening portion 122*o* that faces an opening portion of the second introduction concave portion 13*b*. An end portion of the outlet opening portion 122*o* on the drive shaft 1 side faces an opening portion of the cut-out portion 43 of the cover-side side plate 40.

Figure 6:
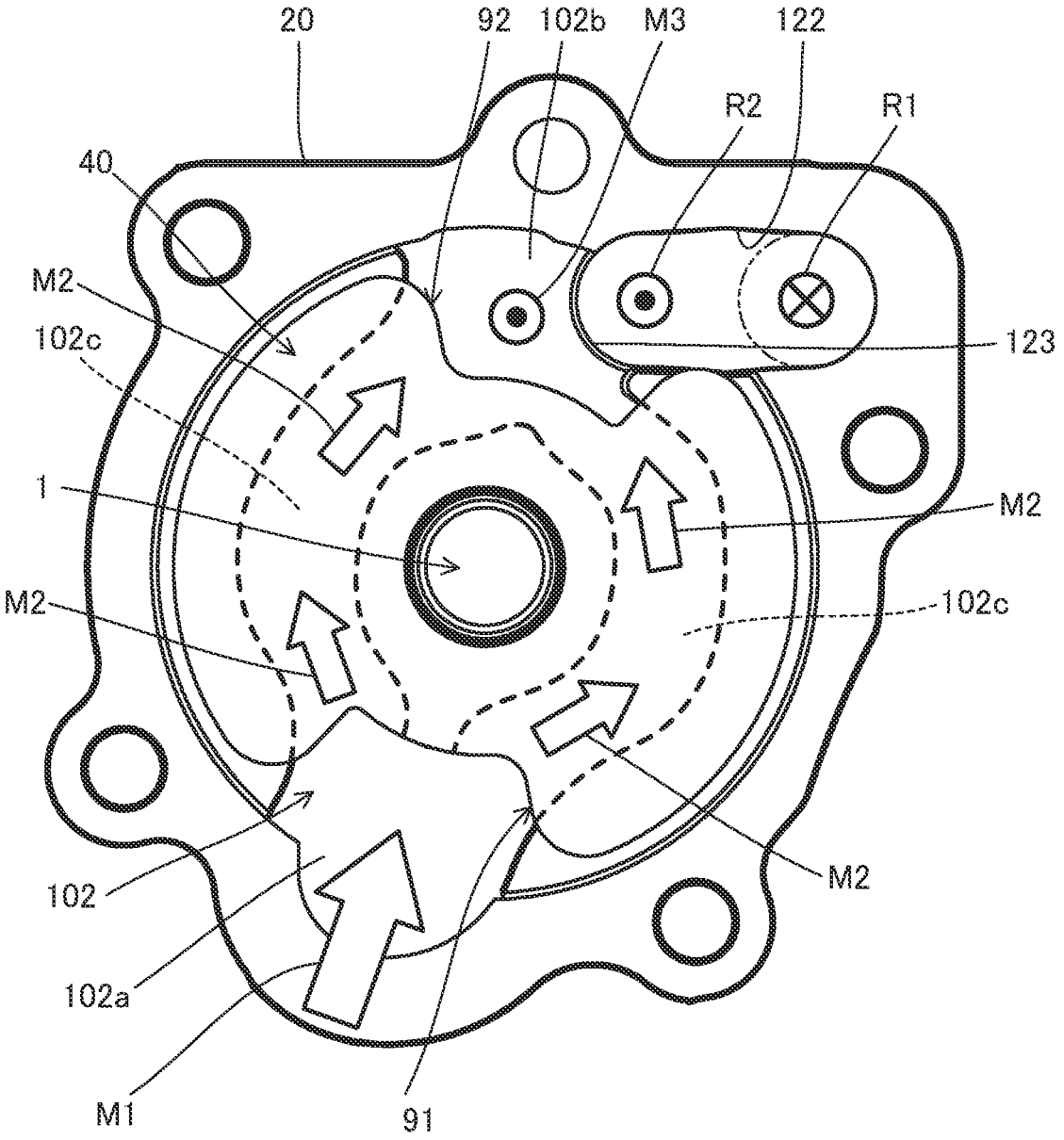
FIG. 6 is a plan view of the cover and the cover-side side plate, viewed from the VI direction in FIG. 4, and shows a flow of working oil (a main flow) guided from a suction passage to a communication passage and the flow of the working oil (a returning flow) flowing through a return passage.

FIG. 6 is a plan view of the cover 20 and the cover-side side plate 40, viewed from the VI direction in FIG. 4. As shown in FIG. 6, the communication passage 102 has an inlet portion 102*a* that is provided in the first suction region 82*a*, an exit portion 102*b* that is provided in the second suction region 82*c*, and two intermediate passages 102*c* that are provided so as to extend between the inlet portion 102*a* and the exit portion 102*b*. The intermediate passages 102*c* are each formed to have an arc shape so as to extend around the drive shaft 1.

The cover 20 is provided with a partition portion 123 that partitions the turning passage 122 and the communication passage 102. As shown in FIG. 1, the partition portion 123 extends from bottom portions of the turning passage 122 and the communication passage 102 (the left end portions in FIG. 1) to an opening plane of the cover 20 along the axial direction.

The flow of the working oil when the vane pump 100 is operated will be described with reference to FIGS. 1 and 6. Arrows shown in FIG. 6 show the directions of the flows of the working oil that is guided from the suction passage 101 to the communication passage 102 and the directions of the flows of the working oil flowing through the return passage 120. In FIG. 6, arrows M1 to M3 show the flows of the working oil (also referred to as a main flow) flowing through the communication passage 102, and arrows R1 and R2 show the flows of the working oil (also referred to as a returning flow) flowing through the return passage 120. In the above, the arrows M3 and R2 show the flows flowing from the back side towards the front side along the straight direction orthogonal to the plane of the drawings, and the arrow R1 shows the flow flowing from the front side towards the back side along the direction orthogonal to the plane of the drawings.

As the drive shaft 1 is rotationally driven by a motive force from the driving device (not shown), such as an engine, etc., the rotor 2 is rotated in the direction shown by the arrow A in FIG. 2. As the rotor 2 is rotated, the pump chambers 6 positioned in the first suction region 82*a* and the second suction region 82*c* are expanded.

With such a configuration, as shown in FIG. 1, the working oil in the tank 60 is guided to the vane pump 100 through a passage 61. The working oil that has been guided to the vane pump 100 is then sucked to the pump chambers 6 positioned in the first suction region 82*a* through the first suction port 91 from the suction passage 101 of the body 10.

In addition, the working oil that has been guided to the vane pump 100 also flows into the communication passage 102 from the suction passage 101 of the body 10. As shown in FIG. 6, the working oil that has been guided from the suction passage 101 to the inlet portion 102*a* of the communication passage 102 (see the arrow M1) is branched and guided to the two intermediate passages 102*c*. The working oil that has been guided to the intermediate passages 102*c* flows along the intermediate passages 102*c* (see the arrow M2), and the flows join together at the exit portion 102*b*. The working oil that has been guided to the exit portion 102*b* is turned and flows along the axial direction and is sucked into the pump chambers 6 positioned in the second suction region 82*c* via the second suction port 92 (see the arrow M3).

Furthermore, as shown in FIG. 1, the excessive oil that is not supplied to the fluid hydraulic apparatus 70 is guided to the body-internal passage 121. The working oil that has been guided to the body-internal passage 121 flows towards the cover 20 along the axial direction and is introduced into the turning passage 122 in the cover 20 (see also the arrow R1 in FIG. 6). The direction of the flow of the working oil that has been introduced to the turning passage 122 is reversed along the inner circumferential surface of the arc shape. In other words, the direction of the flow of the working oil that has been introduced into the cover 20 from the body 10 is converted by the turning passage 122 to the opposite direction. The working oil that has been reversed by the turning passage 122 then flows towards the second introduction concave portion 13*b* and the cut-out portion 43 of the cover-side side plate 40 from the outlet opening portion 122*o* of the turning passage 122 (see also the arrow R2 in FIG. 6).

The working oil that has been guided to the second introduction concave portion 13*b* flows between the second introduction concave portion 13*b* and the outer circumferential surface of the cam ring 4 in the axial direction and is sucked into the pump chambers 6 positioned in the second suction region 82*c* via the body-side side port 51 of the second suction port 92. The working oil that has been guided to the cut-out portion 43 of the cover-side side plate 40 is then sucked into the pump chambers 6 positioned in the second suction region 82*c* via the cover-side side port 52 of the second suction port 92. In the above, a part of the working oil that has been guided to the cut-out portion 43 of the cover-side side plate 40 is redirected by hitting an axial direction end surface 4*g* of the narrow-width portion 4*f*, which is a plane of the cut-out portion 4*d* of the cam ring 4 perpendicular to the axial direction, and is introduced to the pump chambers 6 from the outside of the pump chambers 6 in the radial direction.

As the rotor 2 is rotated, the pump chambers 6 positioned in the first discharge region 82*b* and the second discharge region 82*d* are contracted. Thus, the working oil in the pump chambers 6 is discharged to the high-pressure chamber 14 through the discharge ports 31 (see FIG. 2). The working oil that has been discharged to the high-pressure chamber 14 is then supplied to the external fluid hydraulic apparatus 70 through the discharge passage 62.

Figure 7A:
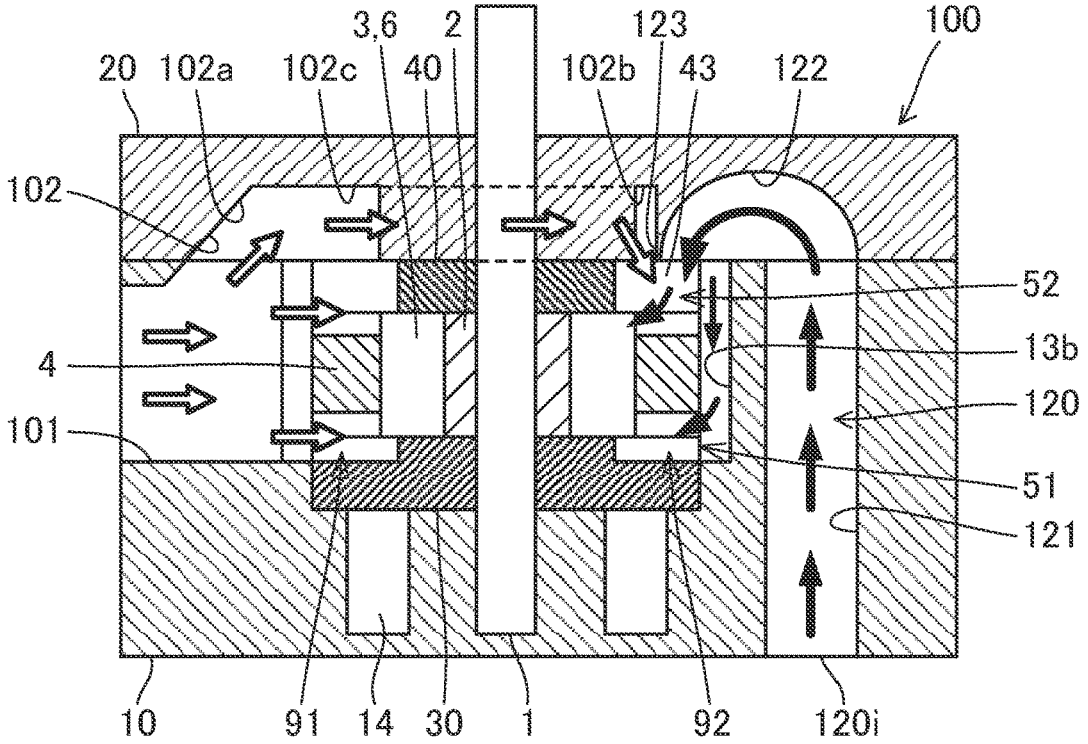
FIG. 7A is a schematic side-sectional view of the vane pump according to this embodiment and shows the flow of the working oil (the main flow) guided from the suction passage to the cartridge and the flow of the working oil (the returning flow) guided from the return passage to the cartridge.
Figure 7B:
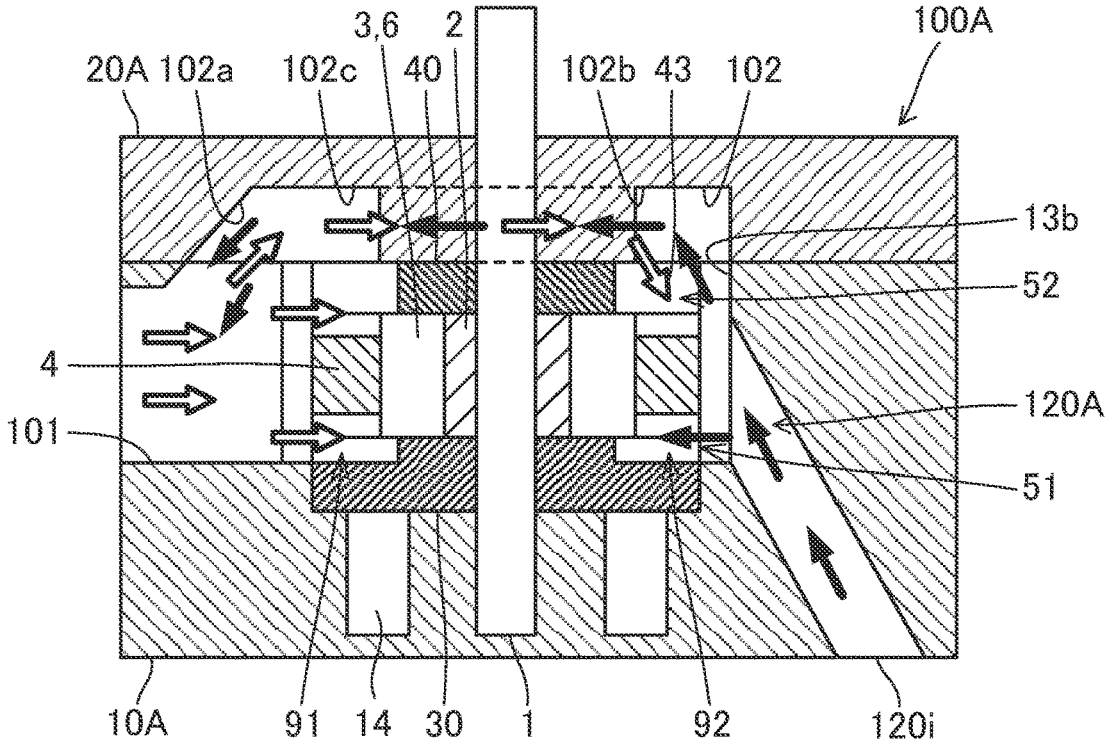
FIG. 7B is the schematic side-sectional view of the vane pump according to a comparative example of this embodiment and shows the flow of the working oil (the main flow) guided from the suction passage to the cartridge and the flow of the working oil (the returning flow) guided from the return passage to the cartridge.

Effects realized by providing the above-described turning passage 122 will be described with reference to FIGS. 7*a* and 7*b* in comparison with a comparative example. FIG. 7A is a schematic side-sectional view of the vane pump 100 according to this embodiment and shows the flow of the working oil (the main flow) that is guided from the suction passage 101 to the cartridge 9 and the flow of the working oil (the returning flow) that is guided from the return passage 120 to the cartridge 9. FIG. 7B is the schematic side-sectional view of a vane pump 100A according to the comparative example of this embodiment and shows the flow of the working oil (the main flow) that is guided from the suction passage 101 to the cartridge 9 and the flow of the working oil (the returning flow) that is guided from a return passage 120A to the cartridge 9. In the figures, the flow of the working oil (the main flow) that is introduced to the suction passage 101 is shown schematically by open arrows, and the flow of the working oil (the returning flow) that is introduced to the return passage 120, 120A is shown schematically by solid arrows.

As shown in FIG. 7B, in the vane pump 100A according to the comparative example of this embodiment, the return passage 120A is provided in a straight line towards the second introduction concave portion 13*b* from an inlet provided on one end of a body 10A in the axial direction (the lower end in the figure), and the turning passage 122 that is described in this embodiment is not provided. Therefore, most of the excessive oil that has been guided to the return passage 120A enters the communication passage 102 from the second introduction concave portion 13*b*.

The direction of the flow of the excessive oil (the returning flow) that is guided from the return passage 120A to the second introduction concave portion 13*b* is in the opposite direction from the direction of the flow of the working oil (the main flow) directed from the suction passage 101 towards the second introduction concave portion 13*b* via the communication passage 102. Therefore, the flow of the working oil to be sucked into the second suction port 92 from the suction passage 101 via the communication passage 102 is inhibited, thus causing a pressure loss.

In addition, remaining excessive oil from the suction at the second suction port 92 forms a counter flow flowing towards the first suction port 91 through the communication passage 102 and inhibits the suction of the flow of the working oil at the first suction port 91 from the suction passage 101, and therefore, there is a concern that the suction property from the first suction port 91 to the pump chamber 6 is deteriorated. Therefore, with the comparative example of this embodiment, there is a concern that the suction property of the vane pump 100A is lowered due to the excessive oil guided by the return passage 120A.

In contrast, in the vane pump 100 according to this embodiment, as shown in FIG. 7A, the excessive oil that has been guided to the body-internal passage 121 of the return passage 120 is reversed by about 180° by the turning passage 122. With such a configuration, it is possible to substantially match the direction of the flow of the working oil (the main flow) directed from the communication passage 102 towards the second suction port 92 and the direction of the flow of the excessive oil (the returning flow) that has been reversed by the turning passage 122 and directed towards the second suction port 92. Therefore, the working oil that has been guided to the second suction port 92 from the suction passage 101 via the communication passage 102 and the excessive oil that has been guided to the second suction port 92 from the return passage 120 are both sucked into the pump chambers 6 in an effective manner. Therefore, because the inhibition caused by the returning flow to the flow of the working oil that is to be sucked into the second suction port 92 from the suction passage 101 via the communication passage 102 is suppressed, the pressure loss is reduced compared with the above-described comparative example.

Note that the cover 20 is provided with the partition portion 123 for partitioning the turning passage 122 and the communication passage 102, and therefore, it is possible to effectively suppress inflow of the excessive oil to the communication passage 102. Therefore, in the cover 20, it is possible to effectively suppress inhibition caused by the excessive oil, which is guided by the turning passage 122, to the flow of the working oil (the main flow) directed to the second suction port 92 from the suction passage 101 via the communication passage 102.

In addition, in this embodiment, each of the cover-side side ports 52 has the cut-out portion 43 that opens to the outer circumferential surface and penetrates through between both end surfaces, and so, the opening of the cover-side side port 52 is formed so as to be larger than the opening of the body-side side port 51. Therefore, it is possible to introduce most of the excessive oil into the pump chambers 6 from the cover-side side port 52 and to introduce the working oil that is guided by the communication passage 102 to the pump chambers 6 from the side of the pump chambers 6. Therefore, it is possible to increase the suction amount into the pump chambers 6 via the second suction port 92. In other words, it is possible to improve the suction property of the pump chambers 6 positioned in the second suction region 82*c*.

Furthermore, in this embodiment, because the excessive oil is efficiently sucked into the pump chambers 6 via the second suction port 92, the formation of the counter flow of the excessive oil directed towards the first suction port 91 via the communication passage 102 is suppressed. Thus, compared with the comparative example, the decrease in the suction property of the pump chambers 6 positioned in the first suction region 82*a* is also suppressed.

As described above, in this embodiment, it is possible to suppress the decrease in the suction property of the vane pump 100 due to the excessive oil guided by the return passage 120. In other words, according to this embodiment, compared with the comparative example, it is possible to improve the suction property of the vane pump 100.

In the above, the turning passage 122 of the cover 20 according to this embodiment can be formed together with the communication passage 102, etc. by a molding processing, and so, compared with a cover 20A in the comparative example, there is no increase in processing steps.

According to the above-described embodiment, following operational advantages are afforded.

The return passage 120 has the body-internal passage 121 through which the excessive oil flows along the rotation center axis O direction of the rotor 2 at the outer side of the cam ring 4 in the radial direction and the turning passage 122 that causes the excessive oil that is guided through the body-internal passage 121 to be reversed towards the second suction port 92. In other words, in this embodiment, it is possible to guide the excessive oil to the second suction port 92 by reversing the excessive oil by the turning passage 122 provided in the cover 20. By doing so, the inhibition of the flow of the working oil directed from the suction passage 101 towards the first suction port 91 and the inhibition of the flow of the working oil directed from the suction passage 101 towards the second suction port 92 via the communication passage 102, which are both caused by the excessive oil, are suppressed. As a result, it is possible to improve the suction property of the vane pump 100.

The following modifications also fall within the scope of the present invention, and it is also possible to combine the configurations shown in the modifications with the configurations described in the above embodiment, or to combine the configurations described in the following different modifications.

Figure 8:
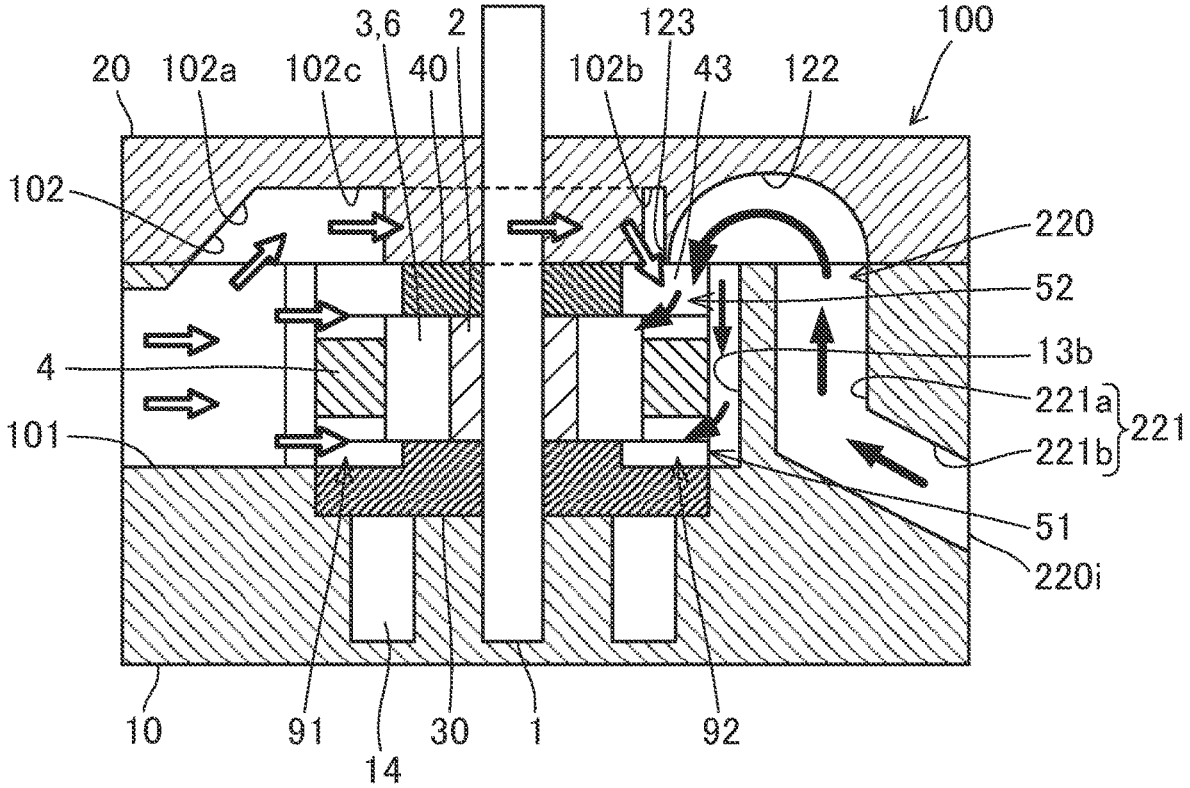
FIG. 8 is the schematic side-sectional view of the vane pump according to a first modification of this embodiment and shows the flow of the working oil (the main flow) guided from the suction passage to the cartridge and the flow of the working oil (the returning flow) guided from the return passage to the cartridge.

In the above-mentioned embodiment, although a description has been given of an example in which the inlet 120*i* of the return passage 120 is formed at the one end surface of the body 10 in the axial direction, the present invention is not limited to this configuration. For example, as in a first modification shown in FIG. 8, an inlet 220*i* of a return passage 220 may be formed at the outer circumferential surface of the body 10. In this first modification, a body-internal passage 221 of the return passage 220 has an axial direction passage 221*a* that is connected to the turning passage 122 and extends in the axial direction and an inlet passage 221*b* that extends from the inlet 220*i* of the return passage 220 and is connected to the axial direction passage 221*a*. Similarly to the body-internal passage 121 in the above-mentioned embodiment, the axial direction passage 221*a* is formed such that the excessive fluid flows along the rotation center axis O direction of the rotor 2 at the outer side of the cam ring 4 in the radial direction. Although the axial direction passage 221*a* is formed so as to be substantially in parallel with the rotation center axis O of the rotor 2, the axial direction passage 221*a* need not be in a parallel in a strict sense, and it may be formed so as to be slightly angled in the radial direction or the circumferential direction with respect to the rotation center axis O. The operational advantages similar to those in the above-mentioned embodiment are also afforded in such a first modification.

Figure 9:
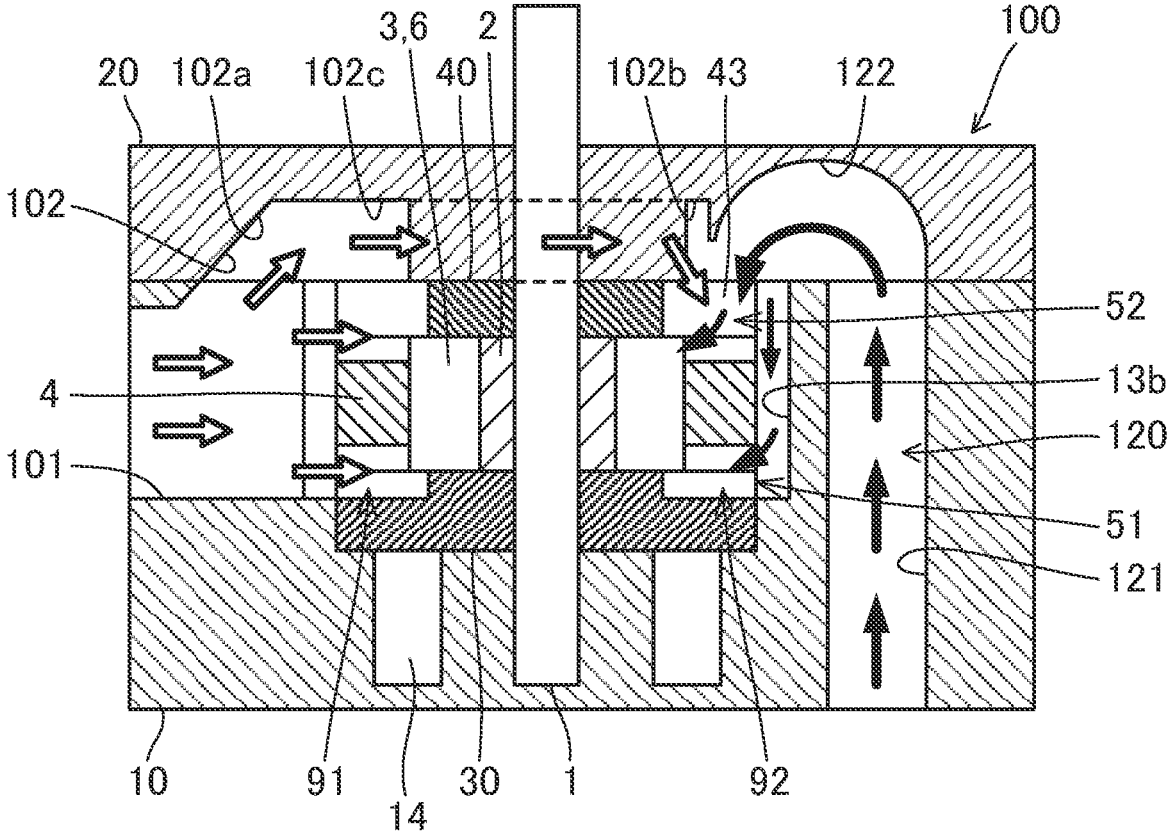
FIG. 9 is the schematic side-sectional view of the vane pump according to a second modification of this embodiment and shows the flow of the working oil (the main flow) guided from the suction passage to the cartridge and the flow of the working oil (the returning flow) guided from the return passage to the cartridge.

In addition, in the above-mentioned embodiment, although a description has been given of an example in which the cover 20 is provided with the partition portion 123 for partitioning the turning passage 122 and the communication passage 102, the present invention is not limited to this configuration. As in a second modification shown in FIG. 9, the turning passage 122 may be in communication with the communication passage 102 in the cover 20. Any configuration may be employed so long as the working oil that has been guided from the body-internal passage 121 to the turning passage 122 of the cover 20 can be at least reversed towards the second suction port 92 by the turning passage 122. The operational advantages similar to those in the above-mentioned embodiment are also afforded in such a second modification.

Figure 10:
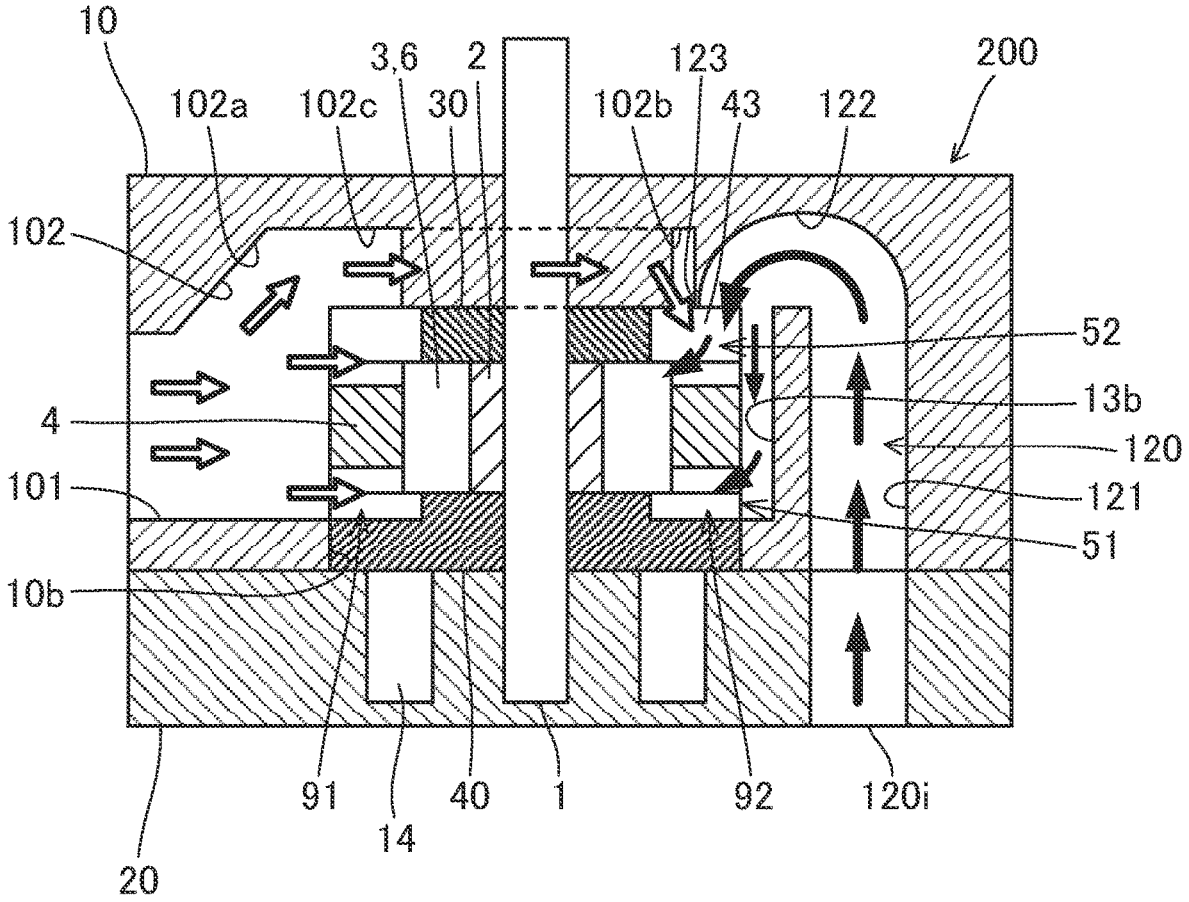
FIG. 10 is the schematic side-sectional view of the vane pump according to a third modification of this embodiment and shows the flow of the working oil (the main flow) guided from the suction passage to the cartridge and the flow of the working oil (the returning flow) guided from the return passage to the cartridge.

In addition, in the above-mentioned embodiment, although a description has been given of an example in which the turning passage 122 and the communication passage 102 are provided in the cover 20, the present invention is not limited to this configuration. As in a third modification shown in FIG. 10, the turning passage 122, the communication passage 102, and the partition portion 123 that partitions these passages may be provided in the body 10. In this case, the annular high-pressure chamber 14 is provided in the cover 20, and the inlet 120*i* of the return passage 120 is provided in the cover 20. In addition, in this case, the cut-out portions 43 forming the side port are formed in the body-side side plate 30 serving as the plate member provided between the communication passage 102 and the pump chamber 6, and not in the cover-side side plate 40 provided between the cover 20 and the cam ring 4. In other words, in the third modification, the side port to which the excessive fluid is guided by the turning passage 122 is formed in the body-side side plate 30. The operational advantages similar to those in the above-mentioned embodiment are also afforded in such a third modification.

In addition, in the above-mentioned embodiment, although a description has been given of an example in which the cut-out portions 4*c* and 4*d* are formed in the cam ring 4, the present invention is not limited to this configuration. Either one or both of the cut-out portions 4*c* and 4*d* of the cam ring 4 may be omitted. In other words, the body-side side ports 51 may be formed only by the recessed portions 33 of the body-side side plate 30, or the cover-side side ports 52 may be formed only by the cut-out portions 43 of the cover-side side plate 40.

In addition, in the above-mentioned embodiment, although a description has been given of an example in which the turning passage 122 is formed so as to have the semicircular cross-sectional shape, the present invention is not limited to this configuration. The turning passage 122 may be formed to have a various shapes that can reverse the working oil that has been guided by the body-internal passage 121 towards the second suction port 92. For example, the turning passage 122 may be formed such that its cross section becomes a triangular shape. In addition, by adjusting an opening angle, an orientation, and a shape of the turning passage 122, it is possible to easily adjust the direction of the flow of the excessive oil.

The configurations, operations, and effects of the embodiment of the present invention configured as described above will be collectively described.

The vane pump 100 has: the rotor 2 configured to be rotationally driven; the plurality of vanes 3 provided so as to be capable of freely reciprocating in the radial direction with respect to the rotor 2; the cam ring 4 having the inner circumference cam face 4*a* on which the tip end portions 3*a* of the plurality of vanes 3 slide with the rotation of the rotor 2; the body 10 having the accommodating concave portion 10*b* for accommodating the rotor 2 and the cam ring 4; the cover 20 attached to the body 10 to close the accommodating concave portion 10*b*; the pump chambers 6 formed by the rotor 2, the cam ring 4, and the adjacent vanes 3; the first suction port 91 configured to guide the working fluid to the pump chambers 6, the working fluid being guided by the suction passage 101 provided in the body 10; the second suction port 92 configured to guide the working fluid to the pump chambers 6, the working fluid being guided from the suction passage 101 through the communication passage 102 provided in the cover 20 or the body 10; and the return passage 120, 220 to which the excessive fluid is guided, the excessive fluid being derived from the working fluid discharged from the pump chambers 6, wherein the return passage 120, 220 has: the axial direction passage (the body-internal passage 121, the axial direction passage 221*a*) through which the excessive fluid flows along the rotation center axis O direction of the rotor 2 at the outer side of the cam ring 4 in the radial direction; and the turning passage 122 configured to reverse the excessive fluid towards the second suction port 92, the excessive fluid being guided through the axial direction passage (the body-internal passage 121, the axial direction passage 221*a*).

With this configuration, it is possible to guide the excessive fluid to the second suction port 92 by reversing the excessive fluid by the turning passage 122. With such a configuration, the inhibition of the flow of the working fluid directed from the suction passage 101 towards the first suction port 91 caused by the excessive fluid and the inhibition of the flow of the working fluid directed from the suction passage 101 towards the second suction port 92 via the communication passage 102 caused by the excessive fluid are suppressed.

In addition, the vane pump 100 further includes the plate member (the body-side side plate 30, the cover-side side plate 40) arranged between the communication passage 102 and the pump chambers 6, wherein the plate member (the body-side side plate 30, the cover-side side plate 40) is provided with the cut-out portions 43, the cut-out portions 43 opening at the outer circumferential surface of the plate member, and the cut-out portions 43 penetrating through between both end surfaces of the plate member, the second suction port 92 has the side port formed by the cut-out portions 43, and the turning passage 122 is configured to reverse the working fluid towards the side port, the working fluid being guided by the axial direction passage (the body-internal passage 121, the axial direction passage 221*a*).

With this configuration, it is possible to increase the suction amount of the working fluid guided to the pump chambers 6 through the second suction port 92.

In addition, in the vane pump 100, the partition portion 123 is provided between the turning passage 122 and the communication passage 102, the partition portion 123 being configured to partition the turning passage 122 and the communication passage 102 in the rotation center axis O direction of the rotor 2.

With this configuration, it is possible to effectively suppress the inhibition of the flow of the working fluid directed towards the second suction port 92 from the suction passage 101 via the communication passage 102 caused by the excessive fluid guided through the turning passage 122.

Embodiments of the present invention were described above, but the above embodiments are merely examples of applications of the present invention, and the technical scope of the present invention is not limited to the specific constitutions of the above embodiments.

This application claims priority based on Japanese Patent Application No. 2019-078491 filed with the Japan Patent Office on Apr. 17, 2019, the entire contents of which are incorporated into this specification by reference.

The invention claimed is:

1. A vane pump comprising:

a rotor configured to be rotationally driven;

a plurality of vanes provided so as to be capable of freely reciprocating in a radial direction with respect to the rotor;

a cam ring having an inner circumference cam face on which tip end portions of the plurality of vanes slide with rotation of the rotor;

a body having an accommodating portion for accommodating the rotor and the cam ring;

a cover attached to the body to close the accommodating portion;

pump chambers formed by the rotor, the cam ring, and the adjacent vanes;

a first suction port configured to guide working fluid to the pump chambers, the working fluid being guided by a suction passage provided in the body;

a second suction port configured to guide the working fluid to the pump chambers, the working fluid being guided from the suction passage through a communication passage provided in the cover or the body; and a return passage to which excessive fluid is guided, the excessive fluid being derived from the working fluid discharged from the pump chambers, wherein the return passage has:

an axial direction passage through which only the excessive fluid flows along a rotation-axis direction of the rotor at an outer side of the cam ring in a radial direction; and a turning passage configured to reverse the excessive fluid towards the second suction port, only the excessive fluid being guided to the turning passage through the axial direction passage, and the axial direction passage and the turning passage are provided separately from the suction passage and the communication passage.

2. The vane pump according to claim 1, further comprising a plate member arranged between the communication passage and the pump chambers, wherein the plate member is provided with a cut-out portion, the cut-out portion opening at an outer circumferential surface of the plate member, and the cut-out portion penetrating through between both end surfaces of the plate member, and the second suction port has a side port formed by the cut-out portion of the plate member, and the turning passage is configured to reverse the working fluid towards the side port, the working fluid being guided by the axial direction passage.

3. The vane pump according to claim 1, wherein a partition portion is provided between the turning passage and the communication passage, the partition portion being configured to partition the turning passage and the communication passage in the rotation-axis direction.

4. A vane pump, comprising:

a rotor configured to be rotationally driven;

a plurality of vanes provided so as to be capable of freely reciprocating in a radial direction with respect to the rotor;

a cam ring having an inner circumference cam face on which tip end portions of the plurality of vanes slide with rotation of the rotor;

a body having an accommodating portion for accommodating the rotor and the cam ring;

a cover attached to the body to close the accommodating portion;

pump chambers formed by the rotor, the cam ring, and the adjacent vanes;

a first suction port configured to guide working fluid to the pump chambers, the working fluid being guided by a suction passage provided in the body;

a second suction port configured to guide the working fluid to the pump chambers, the working fluid being guided from the suction passage through a communication passage provided in the cover or the body;

a return passage to which excessive fluid is guided, the excessive fluid being derived from the working fluid discharged from the pump chambers; and a plate member arranged between the communication passage and the pump chambers, wherein the return passage has:

an axial direction passage through which the excessive fluid flows along a rotation-axis direction of the rotor at an outer side of the cam ring in a radial direction; and a turning passage configured to reverse the excessive fluid towards the second suction port, the excessive fluid being guided through the axial direction passage, the plate member is provided with a cut-out portion, the cut-out portion opening at an outer circumferential surface of the plate member, and the cut-out portion penetrating through between both end surfaces of the plate member, the second suction port has a side port formed by the cut-out portion of the plate member, and the turning passage is configured to reverse the working fluid towards the side port, the working fluid being guided by the axial direction passage.

5. A vane pump, comprising:

a rotor configured to be rotationally driven;

a plurality of vanes provided so as to be capable of freely reciprocating in a radial direction with respect to the rotor;

a cam ring having an inner circumference cam face on which tip end portions of the plurality of vanes slide with rotation of the rotor;

a body having an accommodating portion for accommodating the rotor and the cam ring;

a cover attached to the body to close the accommodating portion;

pump chambers formed by the rotor, the cam ring, and the adjacent vanes;

a first suction port configured to guide working fluid to the pump chambers, the working fluid being guided by a suction passage provided in the body;

a second suction port configured to guide the working fluid to the pump chambers, the working fluid being guided from the suction passage through a communication passage provided in the cover or the body; and a return passage to which excessive fluid is guided, the excessive fluid being derived from the working fluid discharged from the pump chambers, wherein the return passage has:

an axial direction passage through which the excessive fluid flows along a rotation-axis direction of the rotor at an outer side of the cam ring in a radial direction; and a turning passage configured to reverse the excessive fluid towards the second suction port, the excessive fluid being guided through the axial direction passage, and a partition portion is provided between the turning passage and the communication passage, the partition portion being configured to partition the turning passage and the communication passage in the rotation-axis direction.

* * * * *